US006669574B1

(12) United States Patent
Riley et al.

(10) Patent No.: US 6,669,574 B1
(45) Date of Patent: Dec. 30, 2003

(54) GOLF TRAINING DEVICE

(76) Inventors: Thomas P. Riley, P.O. Box 1123, Thonotassa, FL (US) 33592; Beatrice M. Riley, P.O. Box 1123, Thonotassa, FL (US) 33592

( * ) Notice: Subject to any disclaimer, the term of this patent is extended or adjusted under 35 U.S.C. 154(b) by 0 days.

(21) Appl. No.: 10/369,574

(22) Filed: Feb. 21, 2003

(51) Int. Cl.[7] ..... A63B 69/36
(52) U.S. Cl. ..... 473/264; 473/261; 473/279
(58) Field of Search ..... 473/219, 221, 473/222, 224, 225, 261, 264, 265, 257, 278, 279, 262

(56) References Cited

U.S. PATENT DOCUMENTS

| | | | | | |
|---|---|---|---|---|---|
| 4,437,669 | A | * | 3/1984 | Pelz | 473/265 |
| 5,393,065 | A | * | 2/1995 | LeQuyea | 473/260 |
| 5,435,547 | A | * | 7/1995 | Lee | 473/225 |
| 5,527,041 | A | | 6/1996 | Terry, III et al. | |
| 5,797,804 | A | * | 8/1998 | Chen | 473/260 |
| 6,019,685 | A | * | 2/2000 | Fonseca et al. | 473/265 |
| 6,159,106 | A | | 12/2000 | Adams | |
| 6,443,852 | B1 | * | 9/2002 | Kim | 473/265 |
| 6,540,620 | B1 | * | 4/2003 | Consiglio | 473/150 |

FOREIGN PATENT DOCUMENTS

| | | |
|---|---|---|
| DE | 19738313 | 3/1999 |
| GB | 2355668 | 5/2001 |

* cited by examiner

*Primary Examiner*—Stephen Blau
*Assistant Examiner*—Nini F. Legesse
(74) *Attorney, Agent, or Firm*—Richard C. Litman

(57) ABSTRACT

A device for training a golfer to putt correctly using the concept of muscle memory having an adjustable width, elongated guide path between parallel guide members mounted on an elongated pad. The pad has a fixed guide member and a laterally movable guide member allowing the golfer to form a lengthwise guide path of proper width to allow a putter head of a given width to be swung along the guide path. The device, thus adjusted, guides the golfer in swinging the putter along a straight line and hitting the ball along a desired path. Vertically spaced electrodes running the length of the respective guide member inner walls sound a buzzer when the head of the putter makes contact with the guide member wall. Lengthwise reference lines are provided along the guide path. Crosswise lines are located on the tops of the guide members.

19 Claims, 6 Drawing Sheets

GOLF TRAINING DEVICE

BACKGROUND OF THE INVENTION

1. Field of the Invention

The present invention relates to sports training equipment. More particularly, the present invention relates to an apparatus for training a golfer to putt correctly.

2. Description of the Related Art

Training devices for assisting the golfer to develop a proper, consistent putting stroke are known, including the use of a flat base and a channel within which the golfer places a golf ball and places the putter head in a hitting position. The golfer then executes a stroke and the ball hit by the putter head. One of the desired characteristics of putting is to perform a straight back swing and forward stroke. If the golf swing is not straight, the club will touch the wall sometime during the swing. The golfer, however, may not be aware of the first touching of the wall. It would be desirable to provide a channel training device where a signal such as a buzzer is activated when the golfer touches the wall with his putter during the putting stroke.

U.S. Pat. No. 6,159,106, issued Dec. 12, 2000, to Adams, describes a putting training device having a flat base with an adjustable width channel running its length. The user adjusts the width of the channel to a size slightly larger than the putter head so that it passes freely through the channel.

U.S. Pat. No. 5,527,044, issued Jun. 18, 1996, to Terry, III, describes a golf training device for putting having a support base with removable elongated guide rails to provide a guide path for the golfer to move the putter head and a laser light source generating a planar shaped beam of light that is useful in the alignment of the golfer's body and club face before and during the striking of the golf ball.

German Patent Number DE 197 38 313, published Mar. 4, 1993, by Dambacher, describes a golf putting training device having two is guide strips in the swing pane and employs light barrier which determines the putter head position speed during the putting strike.

British Patent Number GB 2 355,668A, published May 2, 2001, by Manage describes a golf putting practice aid which includes ball targets and a sensor such as a bell or alarm to indicate a successful putting strike when the ball hits a target.

None of the above inventions and patents, taken either singularly or in combination, is seen to describe the instant invention as claimed. Thus, a golf training device solving the aforementioned problems is desired.

SUMMARY OF THE INVENTION

The present invention is a device for use in training a golfer to putt correctly using the concept of muscle memory. The device has an adjustable width elongated guide path defined by the inner walls of parallel guide members mounted on an elongated pad. The pad has a fixed guide member and a laterally movable, adjustable guide member located on the elongated pad which allows the golfer to form a lengthwise guide path between the guide members of the proper width to allow a putter head of a given width to be swung along the guide path while provide a desired clearance between the putter and each guide member inner wall. The device, thus adjusted, guides the golfer in swinging the putter along a straight line and hitting the ball along a desired path. One embodiment employs a pad having parallel crosswise grooves corresponding to rails on the underside of the movable guide member for adjusting the width of guide path appropriate for the length of the putter head swung. An alternative embodiment employs a thin pad having countersunk magnetically attracted strips such as iron or steel and the movable guide member has on its underside countersunk magnets corresponding to the strips so as to accurately adjust the width of guide path appropriate for the length of the putter head swung.

Metal contact strips running the length of the interior of the guide member inner walls sound a buzzer when the head of the putter deviates from the desired path and makes contact with the guide member wall. The sound of the buzzer informs the golfer immediately that his swing has deviated from the desired straight back-swing and putting stroke. Lengthwise lines are provided along the guide path on the pad to assist the golfer in placing the ball and determining if the stroked ball travels in a desired straight line. Crosswise lines on the tops of the guide members assist the golfer in determining the length of the back-swing, putting stroke, and follow-through.

Accordingly, it is a principal object of the invention to provide a device which is useful for a golfer to develop a straight putting stroke.

It is another object of the invention to provide a device as above which incorporates an adjustable guide for the putting stroke.

It is a further object of the invention to provide a device as above wherein the guide has a guide path which is adjustable in width to accommodate putter heads of differing size.

Still another object of the invention is to provide a device as above wherein a buzzer sounds when the putter head deviates from the desired straight stroke.

Yet another object of the invention is to provide a device as above having pairs of electrical contacts in the form of metal strips along each side of the guide path which result in a buzzer sounding when a swing of a putter deviates from a desired straight swing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a device for use in training a golfer to putt correctly using the concept of muscle memory. The device is a guide having an adjustable width elongated guide path formed by guide members mounted on an elongated pad. Vertically spaced electrical contacts, mounted on and running the length of the inner guide walls, sound a buzzer when the head of the putter deviates from the desired path and makes contact with the guide member wall, bridging the spaced contacts and, thus, completing the buzzer circuit.

Figure 1:
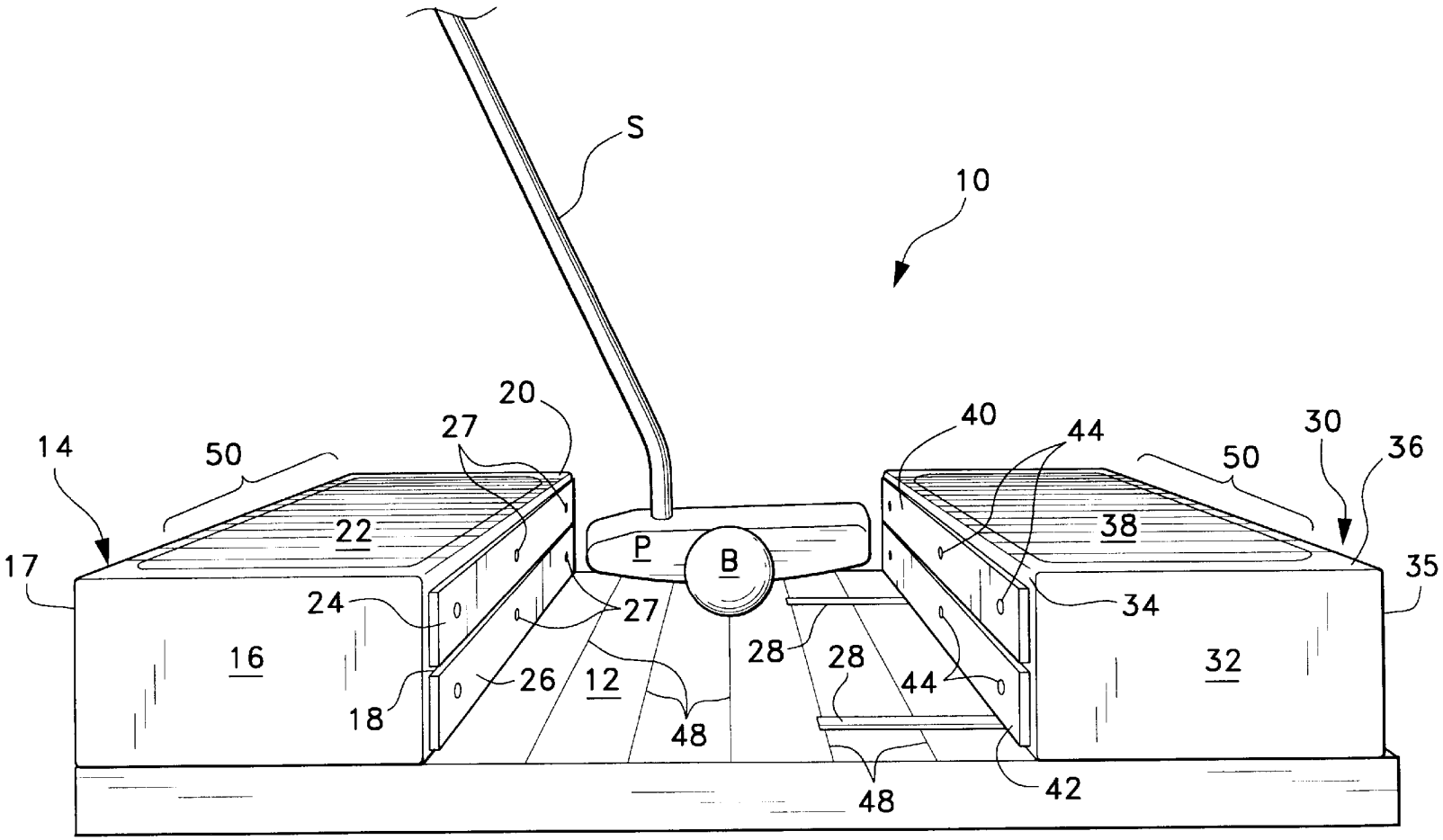
FIG. 1 is an environmental, perspective view of a golf training device according to the present invention.
Figure 2:
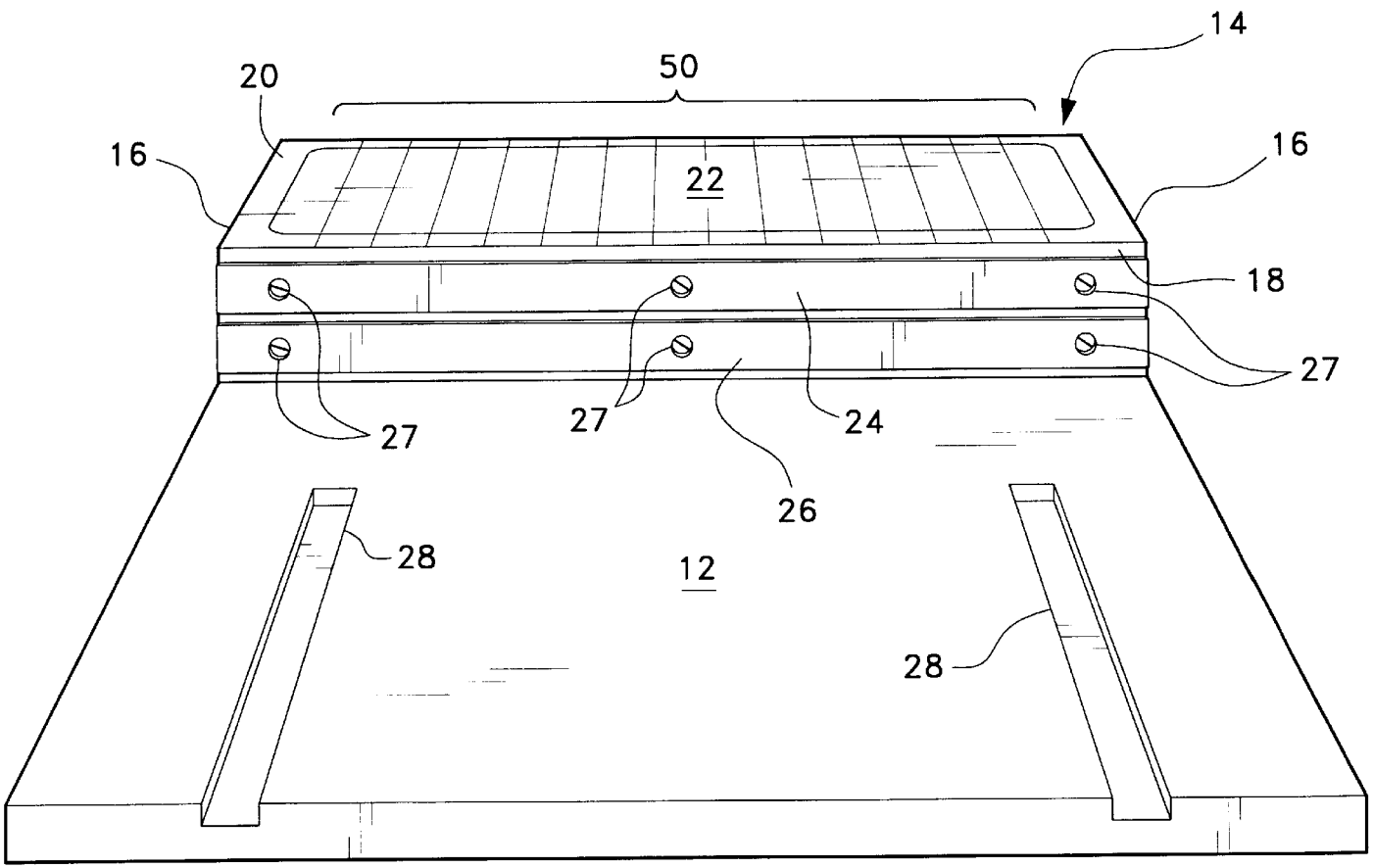
FIG. 2 is a side perspective view of the golf training device of FIG. 1 with the adjustable guide member removed.
Figure 3:
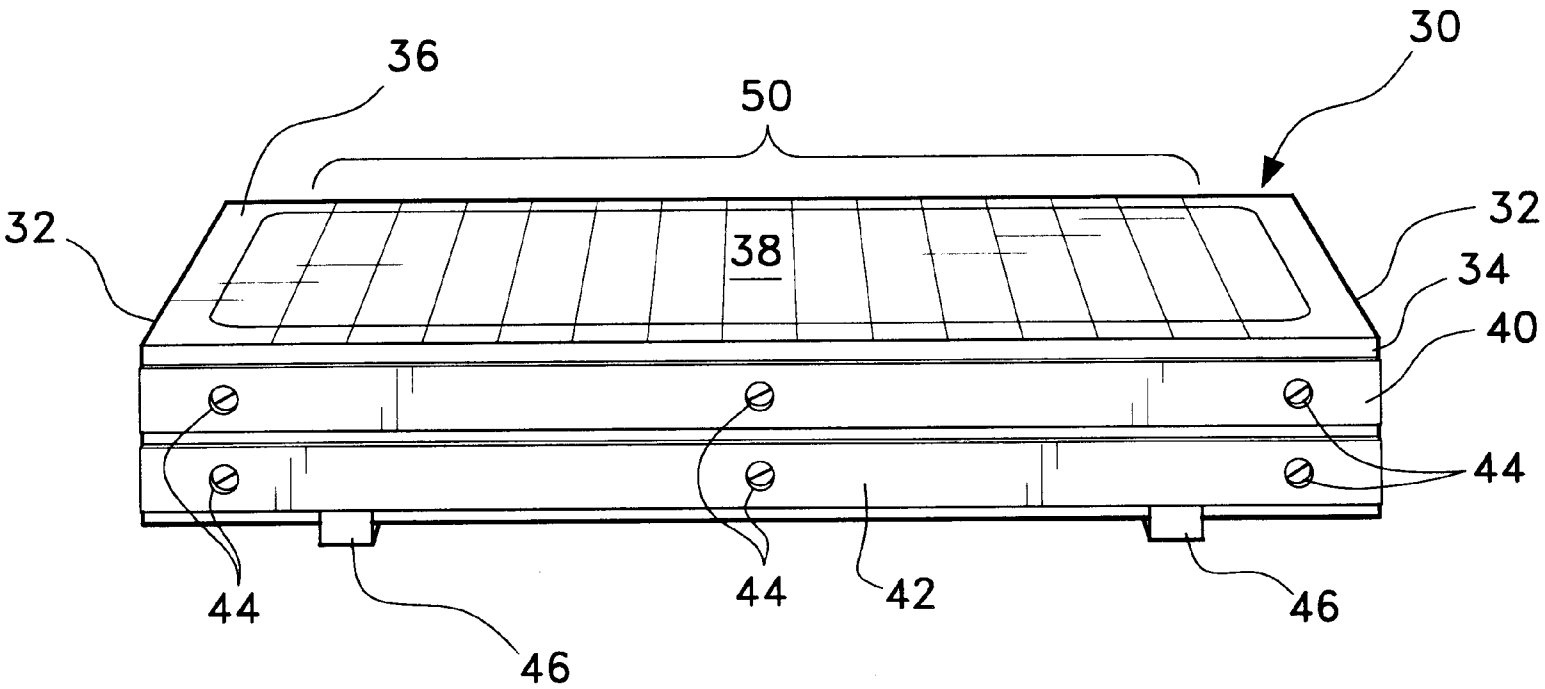
FIG. 3 is a side perspective view of the adjustable guide member of FIG. 1.

Referring to the FIGS. 1–3, there are shown an end perspective view, a side perspective view of the pad and fixed guide member, and a side perspective view of the adjustable guide member of the golf training device 10 of the present invention. Training device 10 has an elongated pad 12 having a fixed guide member 14 fixedly attached on its upper surface along one side thereof. Fixed guide member 14 is in the form of an elongated box having end walls 16, outer side wall 17, inner side wall 18, and a top wall 20 having a removable lid 22, and is made of electrically nonconductive materials.

Upper contact flat 24 and lower contact flat 26 are a pair of vertically spaced, parallel metal electrodes extending along the inner side wall 18 the substantial length of fixed guide member 14 and are mounted thereto by any desired means such as screw fasteners 27. The pad 12 has a pair of pad adjustment slots in its upper surface extending parallel and crosswise to pad 12 to receive adjustable guide member 30. The inner ends of slots 28 are spaced from the inner side wall 18 a distance so as to form a guide path on pad 12 for accommodating the ball B and putter head P when adjustable guide member 30 is fitted in slots 28.

Adjustable guide 30 is similar in configuration and size to fixed guide 14, having end walls 32, inner side wall 34, outer side wall 35, and a top wall 36 having a removable lid 38, and is made of electrically nonconductive materials. Upper contact flat 40 and lower contact flat 42 are a pair of vertically spaced, parallel metal electrodes extending along the inner side wall 34 the substantial length of adjustable guide member 30 and are mounted thereto by any desired means such as screw fasteners 44.

Adjustable guide member 30 rests on two adjustment rails 46 which rest in pad adjustment slots 28 to allow limited adjustment inward and outward of adjustable guide member 30, thus accommodating different putter sizes to be used in the guide. Spaced longitudinal lines 48 are located in the guide path area for assistance in placement of the ball B and in following its direction relative to the guide path when it is stroked by the golfer by putter head P having shaft S. Crosswise guide lines 50 are spaced along the top walls 18 and 36 and their included lids 22 and 38 to assist the golfer in gauging the length of his stroke.

Figure 4:
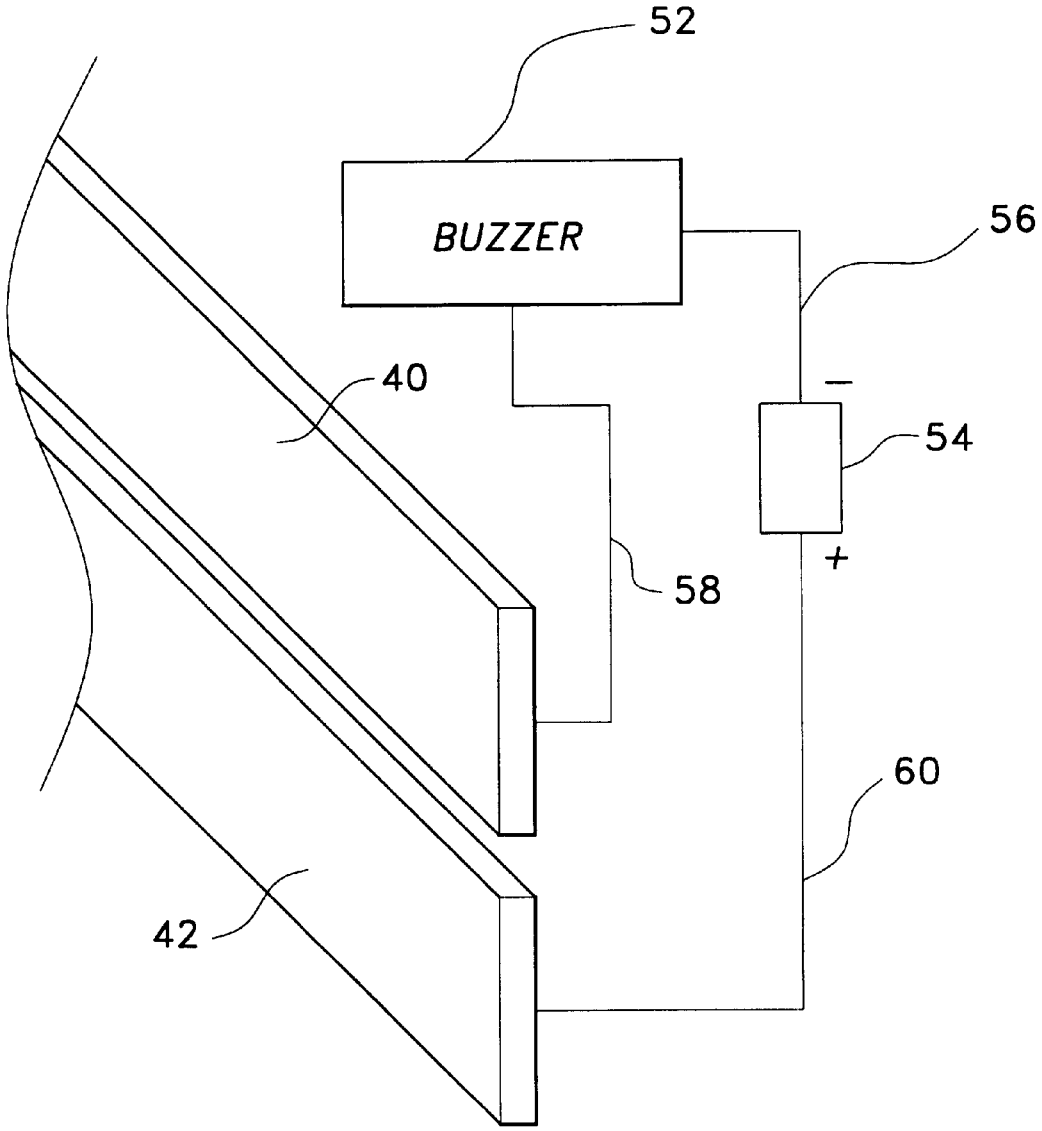
FIG. 4 is a diagrammatic illustration of a buzzer system as attached between a pair of metal strips as shown in FIG. 1.
Figure 5:
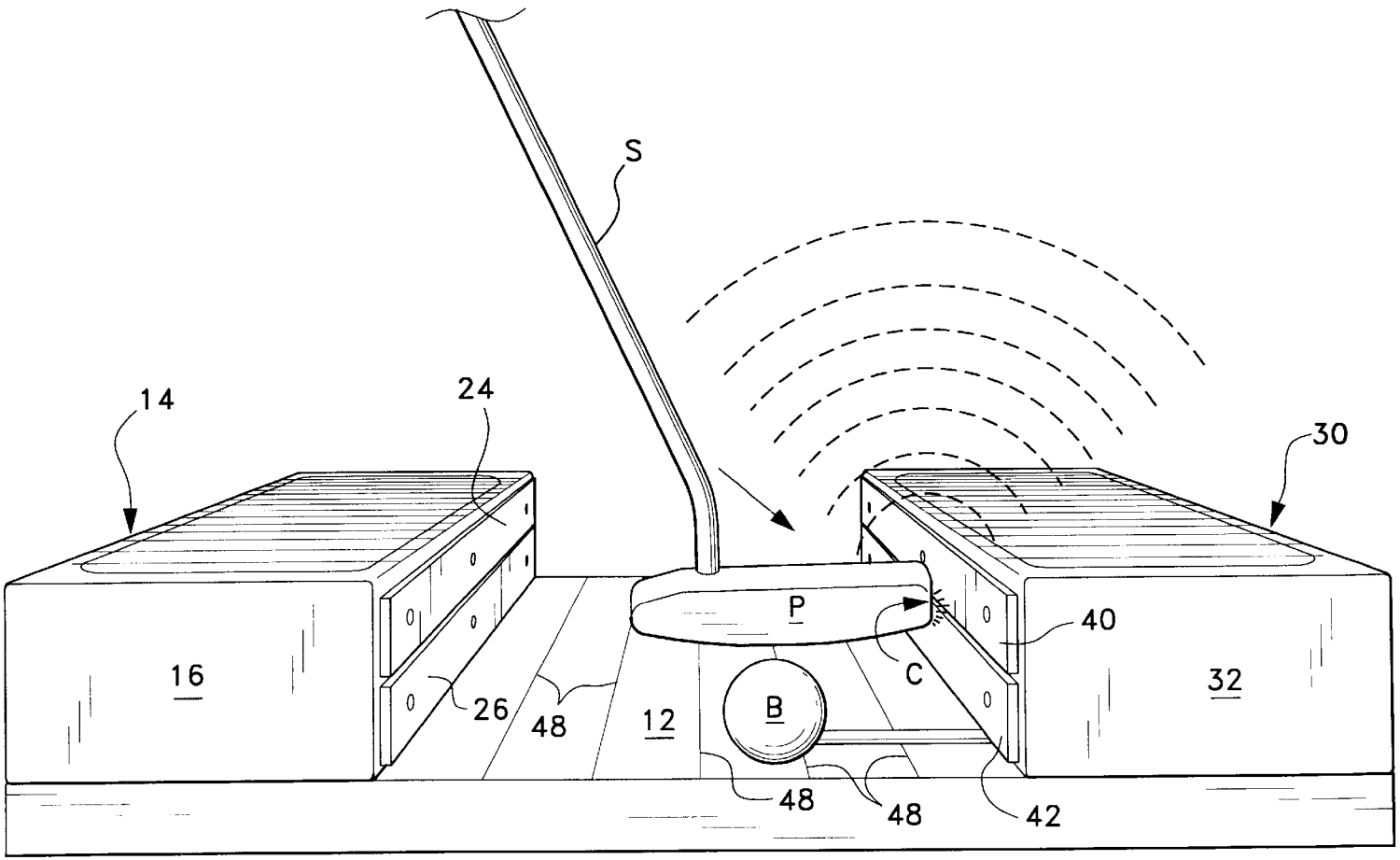
FIG. 5 is an environmental, perspective view of the golf training device as in FIG. 1 illustrating the positions of the putter and ball upon a miss-hit with the putter engaging the pair of metal strips and thus completing the buzzer circuit resulting in a buzzing sound.

Referring to FIGS. 4 and 5, there are respectively shown a diagrammatic illustration of a pair of contact metal flats such as upper flat 40 and lower flat 42 as part of the buzzer alert feature, and an environmental perspective view similar to that of FIG. 1 with the putter head electrically connecting the contact metal flats 40 and 42. Lower flat 42 is electrically connected to battery 54 at its positive pole, buzzer 52 is electrically connected to battery 54 at its positive pole, and buzzer 52 is electrically connected to upper flat 40. As illustrated in FIG. 5, there is shown the ball B hit offline and the putter head P electrically connecting upper flat 40 and lower flat 42 at contact point C, thus completing the buzzer circuit (see FIG. 4) and causing the buzzer alert to sound.

Figure 6:
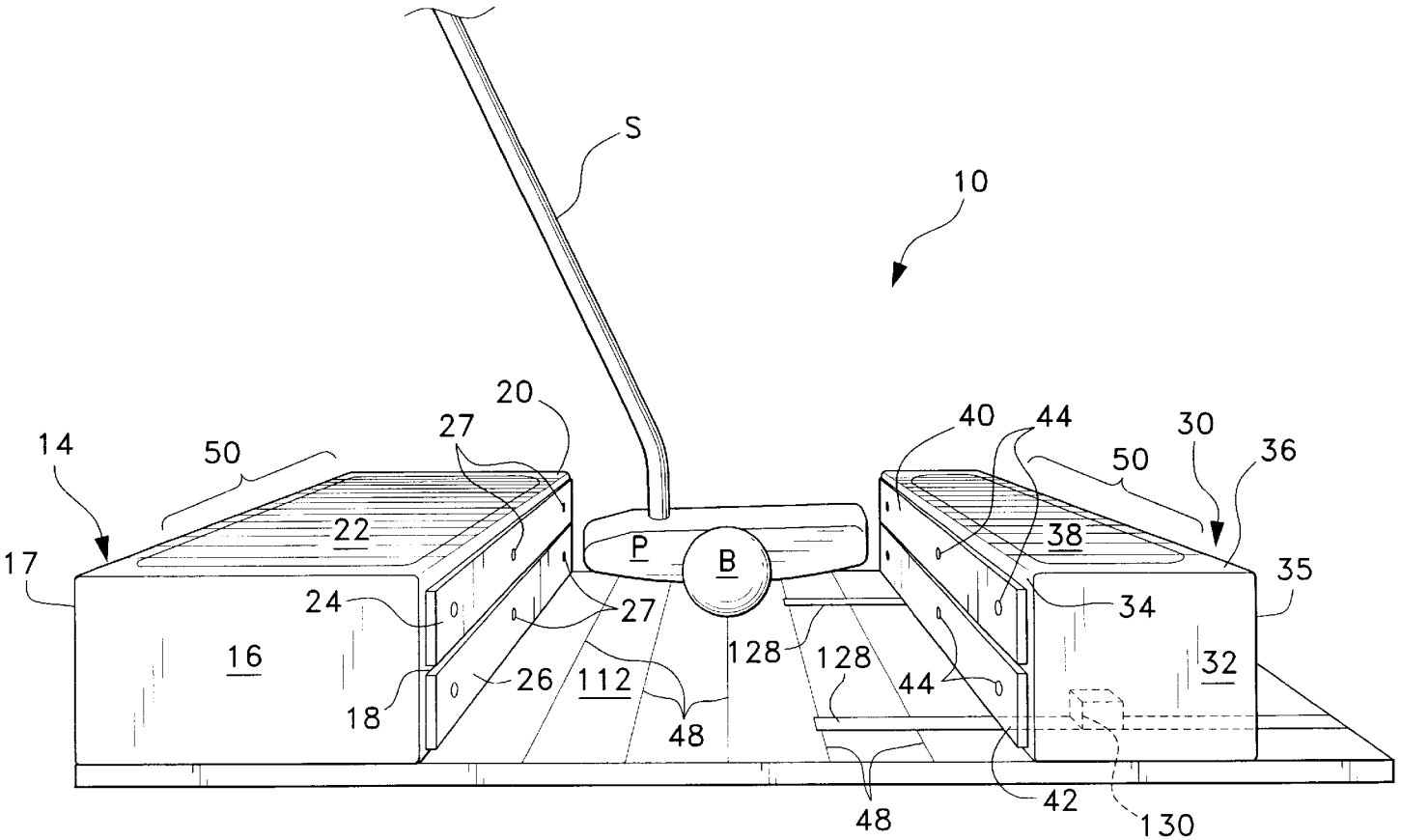
FIG. 6 is an environmental, perspective view similar to that of FIG. 1, showing an alternative embodiment of the invention.

Referring to FIG. 6, there is shown an alternative embodiment similar to that of FIG. 1 which enables the use of a thin elongated pad 112 having fixed guide member 14 as in FIG. 1. In this embodiment, thin strips 128 of Ferromagnetic material such as iron or steel are countersunk flush with the upper surface of pad 112, in place of grooves 28, allowing the pad 112 to be substantially thinner than the grooved pad 12. In this embodiment, adjustable guide 30(shown in a narrower embodiment) contains countersunk magnets 130 (one shown) even with the underside of the adjustable guide 30. In this embodiment the guide 30 is movable inward or outward while retaining its desired orientation due to the magnets 130 maintaining alignment with the strips of iron or steel 128. This allows for the use of a thin pad 112 which, in turn, allows for easier use of the golf training device 10.

A separate buzzer and battery are preferably placed in each boxlike guide member and leads attached to their respective electrode flats. The buzzer and battery may be conveniently mounted inside the guide member and the batteries replaced by removing the lid. The circuitry may be attached to the electrodes by attachment to the inner ends of the screw fasteners or by providing a hole through the inner wall for contact as by soldering with the desired electrode in a known manner. More than one pair of lengthwise electrodes may be vertically spaced along a guider member inner wall to detect contact of the putter head at different levels as desired along with added circuitry to activate the buzzer in a well-known manner.

Also, a number of vertically oriented, horizontally spaced pairs of electrodes may be distributed along the length of the guide member inner wall, each pair being electrically connected with electrical circuitry to activate the buzzer in a well-known manner. Other variations of electrode placement along guide member inner walls are contemplated by the present invention such that a buzzer is activated upon the putter head touching the electrode-bearing wall.

The surface of the pad is preferably covered with felt material for a better appearance and to improve observation of the stroked ball. The invention may also simply embody the two, buzzer-containing guide members which may be freely arranged by the golfer, or one guide member may be fixed to a web of felt or carpet and the adjustable guide member placed as desired by the golfer.

It is to be understood that the present invention is not limited to the embodiment described above, but encompasses any and all embodiments within the scope of the following claims.

We claim:

1. A golf training device comprising:

a first elongated guide member having an inner wall;

a second elongated guide member having an inner wall and spaced from and generally parallel to said first elongated guide member inner wall to form an elongated putting guide path therebetween;

said first guide member having at least two spaced electrodes located on said inner wall thereof;

said first guide member having an audible buzzer and a source of electrical power forming an electrical circuit with said at least two spaced electrodes;

said second guide member having at least two spaced electrodes located on said inner wall thereof; and said second guide member having an audible buzzer and a source of electrical power forming an electrical circuit with said at least two spaced electrodes;

whereby, upon a golfer spacing said first guide member and said second guide member such that an electrically conductive golf putter head maintains a desired clearance therebetween when stroked in a desired direction; and whereby upon a golfer executing a putter stroke within said putter guide with the putter head, a buzzer is sounded upon said putter head making contact between two of said spaced electrodes indicating that the putter stroke varied from the guide path.

2. The golf training device of claim 1, further comprising a pad upon which said first and said second guide members are placed, further defining said elongated putting guide path.

3. The golf training device of claim 2, wherein said first guide member is fixed to said pad and said second guide member is an adjustable guide laterally movable relative to said fixed guide member; whereby said putting guide path is adjusted in width so as to accommodate a range of putter head widths.

4. The golf training device of claim 3, wherein said pad has a pair of spaced, parallel locating means for said adjustable guide member, said locating means being perpendicular to the inner walls of said fixed guide and spaced therefrom a distance such as to define the minimum width of said putting guide path.

5. The golf training device of claim 4, wherein said locating means are spaced parallel grooves cut in said pad and said adjustable guide member has a pair of rails corresponding with said parallel grooves perpendicular to said adjustable guide member inner wall, whereby said adjustable guide member may be moved perpendicularly relative to said inner wall of said fixed guide member.

6. The golf training device of claim 4, wherein said locating means are spaced parallel Ferromagnetic strips countersunk level with the upper surface of said pad corresponding with magnets countersunk level with the underside of said adjustable guide member, whereby said adjustable guide member may be move perpendicularly relative to said inner wall of said fixed guide member.

7. The golf training device of claim 2, wherein said guide path is marked by spaced longitudinal lines on said pad.

8. The golf training device of claim 1, wherein said at least two spaced electrodes located on said first guide member inner wall are vertically spaced and extend lengthwise therealong substantially the length of said first guide member.

9. The golf training device of claim 1, wherein said at least two spaced electrodes located on said second guide member inner wall are vertically spaced and extend lengthwise therealong substantially the length of said second guide member.

10. The golf training device of claim 1, wherein said guide members each have a top surface having crosswise guide lines spaced therealong relative to said guide path.

11. The golf training device of claim 1, wherein said electrodes are attached to said respective inner walls of said guide members by screws.

12. A golf training device comprising:

an elongated rectangular pad;

a fixed guide member affixed to said elongated rectangular pad located along one side of said pad, said guide member having the configuration of an elongated box having an inner wall;

an adjustable guide member located on said pad spaced from and parallel to said fixed guide member and having the configuration of an elongated box having an opposite inner wall;

said inner walls of said parallel guide members defining a elongated putting guide path on said pad;

each of said guide members having at least two vertically spaced electrodes located on and extending the length of said respective inner wall;

each said guide members having an audible buzzer and a source of electrical power forming an electrical circuit with its respective vertically spaced electrodes;

said pad having a pair of spaced, parallel locating means for said adjustable guide member, said locating means being perpendicular to the inner wall of said fixed guide and spaced therefrom a distance such as to define the minimum width of said putting guide path;

whereby upon a golfer executing a putter stroke within said putter guide with the putter head, a buzzer sounds upon said putter head making contact between two of said vertically spaced electrodes, indicating that the putter stroke varied from the putter guide path.

13. The golf training device of claim 12, wherein said locating means are spaced parallel grooves cut in said pad and said adjustable guide member has a pair of rails corresponding with said parallel grooves perpendicular to said adjustable guide member inner wall, whereby said adjustable guide member may be moved perpendicularly relative to said inner wall of said fixed guide member.

14. The golf training device of claim 12, wherein said locating means are spaced parallel Ferromagnetic strips countersunk level with the upper surface of said pad corresponding with magnets countersunk level with the underside of said adjustable guide member, whereby said adjustable guide member may be move perpendicularly relative to said inner wall of said fixed guide member.

15. The golf training device of claim 12, wherein said guide members each have a top surface having crosswise guide lines spaced therealong relative to said guide path.

16. The golf training device of claim 12, wherein said guide path is marked by spaced, longitudinal lines on said pad.

17. The golf training device of claim 12, wherein said electrodes are attached to said respective inner walls of said guide members by screws.

18. The golf training device of claim 17, wherein said battery may be replaced by removing said removable lid.

19. The golf training device of claim 12, wherein each said guide member has a top and a removable lid and said source of electrical power is a battery, said buzzer, said battery and said circuitry being contained within said guide member.

* * * * *